US006208080B1

(12) United States Patent
King et al.

(10) Patent No.: US 6,208,080 B1
(45) Date of Patent: Mar. 27, 2001

(54) MAGNETIC FLUX SHAPING IN ION ACCELERATORS WITH CLOSED ELECTRON DRIFT

(75) Inventors: David Q. King, Woodinville; Kristi H. de Grys, Bellevue; Randall S. Aadland, Kirkland; Dennis L. Tilley, Redmond; Arnold W. Voigt, Bellevue, all of WA (US)

(73) Assignee: Primex Aerospace Company, Redmond, CA (US)

( * ) Notice: Subject to any disclaimer, the term of this patent is extended or adjusted under 35 U.S.C. 154(b) by 0 days.

(21) Appl. No.: 09/191,749

(22) Filed: Nov. 13, 1998

Related U.S. Application Data

(60) Provisional application No. 60/088,164, filed on Jun. 5, 1998.

(51) Int. Cl.[7] ..... H05H 1/54; H01J 27/02

(52) U.S. Cl. ..... 315/111.41; 315/111.21; 315/111.61; 315/111.91; 313/362.1; 60/202

(58) Field of Search ..... 315/111.41, 111.61, 315/111.91, 111.21; 313/362.1; 60/202

(56) References Cited

U.S. PATENT DOCUMENTS

| | | | |
|---|---|---|---|
| 3,735,591 | 5/1973 | Burkhart . | |
| 4,277,939 | 7/1981 | Hyman, Jr. . | |
| 4,862,032 | 8/1989 | Kaufman et al. . | |
| 5,218,271 | 6/1993 | Egorov et al. . | |
| 5,357,747 | 10/1994 | Myers et al. . | |
| 5,359,258 | 10/1994 | Arkhipov et al. . | |
| 5,475,354 | 12/1995 | Valentian et al. . | |
| 5,581,155 | 12/1996 | Morozov et al. . | |
| 5,763,989 | 6/1998 | Kaufman . | |
| 5,798,602 | 8/1998 | Gopanchuk et al. . | |
| 5,838,120 * | 11/1998 | Semenkin et al. | 315/505 |
| 5,845,880 | 12/1998 | Petrosov et al. . | |
| 5,847,493 | 12/1998 | Yashnov et al. . | |
| 5,892,329 * | 4/1999 | Arkhipov et al. | 315/111.11 |
| 6,075,321 * | 6/2000 | Hruby | 315/111.91 |

FOREIGN PATENT DOCUMENTS

| | | |
|---|---|---|
| 01077764 | 3/1989 | (JP) . |
| 1715183 | 4/1994 | (SU) . |
| WO 97/37127 | 10/1997 | (WO) . |
| WO 97/37517 | 10/1997 | (WO) . |

OTHER PUBLICATIONS

A.I. Morozov et al., "Plasma Accelerator With Closed Electron Drift and Extended Acceleration Zone," *Soviet Physics—Technical Physics*, vol. 17, No. 1, pp. 38–45 (1972).

(List continued on next page.)

*Primary Examiner*—Bruce C. Anderson
*Assistant Examiner*—Nikita Wells
(74) *Attorney, Agent, or Firm*—Christensen O'Connor Johnson Kindness PLLC

(57) ABSTRACT

A specially designed magnetic shunt is provided encircling the anode region and/or annular gas distribution area of an ion accelerator with closed electron drift. The magnetic shunt is constructed to concentrate the magnetic field at the ion exit end, such that the location of maximum magnetic field strength is located downstream from the inner and outer magnetic poles of the accelerator. The specially designed shunt also results in desired curvatures of magnetic field lines upstream of the line of maximum magnetic field strength, to achieve a focusing effect for increasing the life and efficiency of accelerator.

29 Claims, 13 Drawing Sheets

OTHER PUBLICATIONS

A.I. Morozov et al., "Effect of the Magnetic Field on a Closed–Electron–Drift Accelerator," *Soviet Physics—Technical Physics*, vol. 17, No. 3, pp. 482–487 (1972).

H.R. Kaufman, "Technology of Closed–Drift Thrusters," *AIAA Journal*, vol. 23, No. 1, pp. 78–87 (1995).

V.M. Gavryushin et al., "Effect of the Characteristics of a Magnetic Field on the Parameters of an Ion Current at the Output of an Accelerator With Closed Electron Drift," *American Institute of Physics*, pp. 505–507 (1981).

C.O. Brown et al., "Further Experimental Investigations of a Cesium Hall–Current Accelerator," *AIAA Journal*, vol. 3, No. 5, pp. 853–859 (1965).

S.N. Kulagin et al., "Some Results of Investigation of Anode Design Influence on Anode Layer Thruster Characteristics," $24^{th}$ International Electric Propulsion Conference, Moscow, Russia, pp. 1–5 (Sep. 19–23, 1995).

R.X. Meyer, "A Space–Charge–Sheath Electric Thruster," *AIAA Journal*, vol. 5, No. 11, pp. 2057–2059 (1967).

* cited by examiner

MAGNETIC FLUX SHAPING IN ION ACCELERATORS WITH CLOSED ELECTRON DRIFT

This application claims the benefit of U.S. Provisional application No. 60/088,164, filed Jun. 5, 1998.

FIELD OF THE INVENTION

The present invention relates to a system for "shaping" the magnetic field in an ion accelerator with closed drift of electrons, i.e., a system for controlling the contour of the magnetic field lines and the strength of the magnetic field in a direction longitudinally of the accelerator, particularly in the area of the ion exit end.

BACKGROUND OF THE INVENTION

Ion accelerators with closed electron drift, also known as "Hall effect thrusters" (HETs), have been used as a source of directed ions for plasma assisted manufacturing and for spacecraft propulsion. Representative space applications are: (1) orbit changes of spacecraft from one altitude or inclination to another; (2) atmospheric drag compensation; and (3) "stationkeeping" where propulsion is used to counteract the natural drift of orbital position due to effects such as solar wind and the passage of the moon. HETs generate thrust by supplying a propellant gas to an annular gas discharge area. Such area has a closed end which includes an anode and an open end through which the gas is discharged. Free electrons are introduced into the area of the exit end from a cathode. The electrons are induced to drift circumferentially in the annular discharge area by a generally radially extending magnetic field in combination with a longitudinal electric field. The electrons collide with the propellant gas atoms, creating ions which are accelerated outward due to the longitudinal electric field. Reaction force is thereby generated to propel the spacecraft.

It has long been known that the longitudinal gradient of magnetic flux strength has an important influence on operational parameters of HETs, such as the presence or absence of turbulent oscillations, interactions between the ion stream and walls of the thruster, beam focusing and/or divergence, and so on. Such effects have been studied for a long time. See, for example, Morozov et al., "Plasma Accelerator With Closed Electron Drift and Extended Acceleration Zone," *Soviet Physics-Technical Physics*, Vol. 17, No. 1, pages 38–45 (July 1972); and Morozov et al., "Effect of the Magnetic Field on a Closed-Electron-Drift Accelerator," *Soviet Physics-Technical Physics*, Vol. 17, No. 3, pages 482–487 (September 1972). The work of Professor Morozov and his colleagues has been generally accepted as establishing the benefits of providing a radial magnetic field with increasing strength from the anode toward the exit end of the accelerator. For example, H. R. Kaufman in his article "Technology of Closed-Drift Thrusters," *AIAA Journal*, Vol. 23, No. 1, pages 78–87 (July 1983), characterizes the work of Morozov et al. as follows:

> The efficiency of a long acceleration channel thus is improved by concentrating more of the total magnetic field near the exhaust plane, in effect making the channel shorter. Another interpretation, perhaps equivalent, is that ions produced in the upstream portion of a long channel have little chance of escape without striking the channel walls. Concentration of the magnetic field at the upstream end of the channel therefore should be expected to concentrate ion production further upstream, thereby decreasing the electrical efficiency.

Id. at 82–83. For experimental purposes, Morozov et al. achieved different profiles for the radial magnetic field by controlling the current to coils of separate electromagnets. For a given magnetic source (electromagnet or permanent magnets), other ways to affect the profile of the magnetic field are configuring the physical parameters of magnetic-permeable elements in the magnetic path (such as positioning and concentrating magnetic-permeable elements at the exit end of the accelerator), and by magnetic "screening" or shunts which can be interposed between the source(s) of the magnetic field and areas where less field strength is desired, such as near the anode. For example, in their paper titled "Effect of the Characteristics of a Magnetic Field on the Parameters of an Ion Current at the Output of an Accelerator with Closed Electron Drift," *Sov. Phys. Tech. Phys.*, Vol.26, No. 4 (April 1981), Gavryushin and Kim describe altering the longitudinal gradient of the magnetic field intensity by varying the degree of screening of the accelerator channel. Their conclusion was that magnetic field characteristics in the accelerator channel have a significant impact on the divergence of the ion plasma stream.

There does not appear to be any current dispute that the longitudinal gradient of magnetic field strength in HETs is important, and that it is desirable to concentrate or intensify the magnetic field at or adjacent to the exit plane as compared to the magnetic field strength farther upstream.

SUMMARY OF THE INVENTION

The present invention provides an improved system for magnetic flux shaping in an ion accelerator with closed electron drift (Hall effect thruster or HET). A specially designed magnetic shunt called a "flux bypass cage" is provided encircling the anode region and/or annular gas distribution area of the thruster at both the inside cylindrical wall and outside cylindrical wall. The circumferential sides of the flux bypass cage are connected behind the anode. Initially, the cage was formed by a solid walled, U-shaped cross section body of revolution, with the inner and outer sides encompassing substantially all of the anode region of the thruster. This construction was shown to be effective to steepen the axial gradient of the magnetic field strength and move the zone where ions are created downstream, as confirmed by measurement of the erosion profile of ceramic insulators adjacent to the exit end of the thruster. In the preferred embodiment of the present invention, however, the flux cage has large openings in the inner and outer circumferential sides. The open areas can constitute the major portion of both the outer and inner circumferential sides, hence the term "cage." The flux bypass cage then resembles circumferentially spaced, longitudinally extending side bars connecting rings at the closed end (behind the anode) and rings at the exit end. With this construction, it has been found that desired profiles for the magnetic field can be achieved with substantially less total magnetic coercive force being required. Therefore, electromagnets can have fewer ampere-turns, as well as lighter cores and structural supports, and the reduction in weight lessens structural support requirements for the thruster itself. For systems using permanent magnets, smaller, lighter magnets can be used. Another feature of the cage design is that it gives the designer control over the shape of the magnetic field vectors in the ion discharge area. For example, a solid walled shunt can create lines of equipotential at steep angles relative to the centerline of the discharge area. The result is that the ion beam can be "over focused," i.e., have ions at the inner and outer sides directed more toward the mid-channel centerline than is desired for greatest efficiency. Large open areas in the cage also permit radiative cooling of the thruster, reducing or eliminating the need for heavy thermal shunts to conduct heat away from the core of the thruster. In another aspect of the invention, the magnet poles at the exit end of the HET are coated with insulative material, which further enhances the magnetic field shaping for greater efficiency and longer life.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
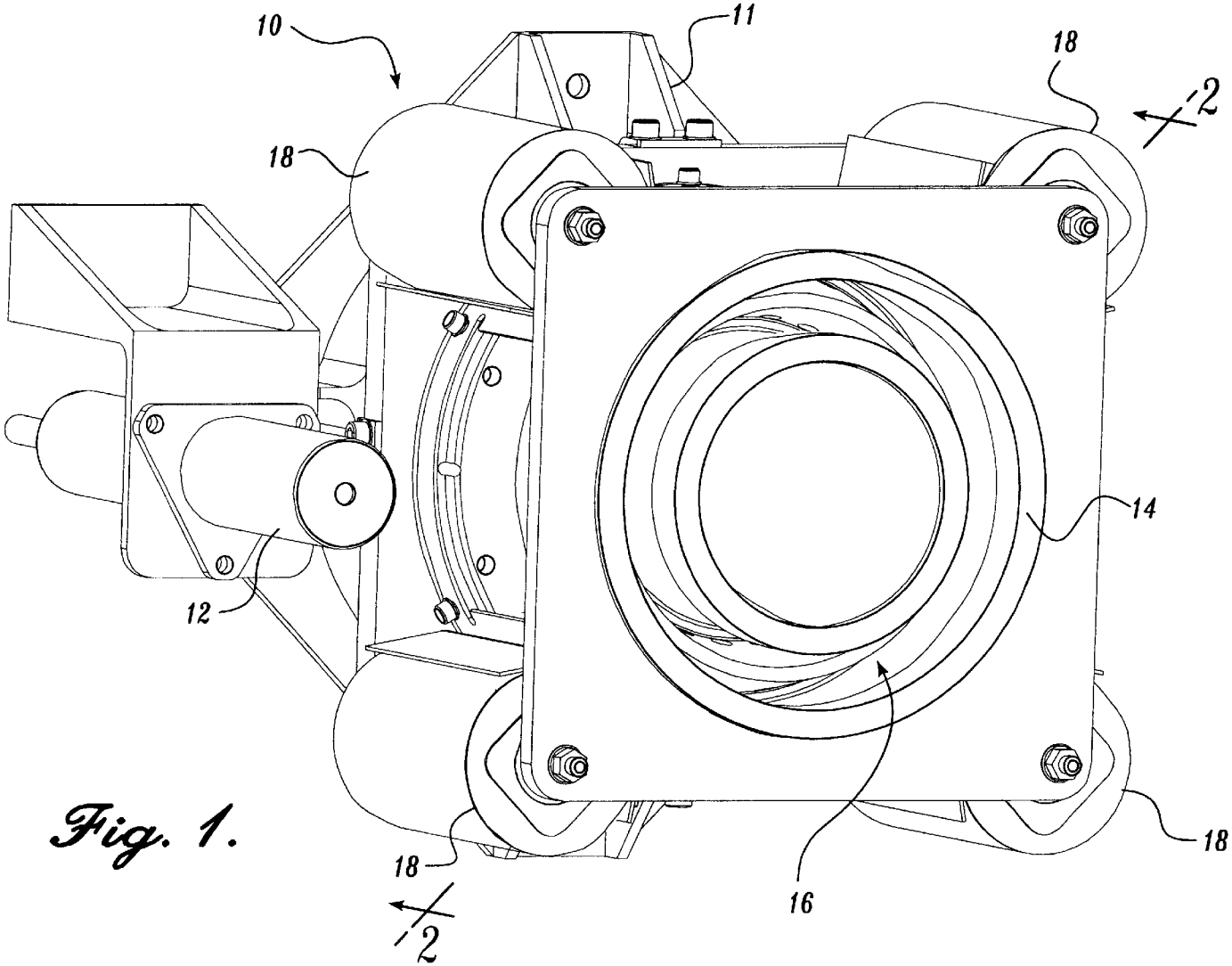
FIG. 1 is a somewhat diagrammatic, top, exit end perspective of an ion accelerator with closed electron drift of a representative type with which the present invention is concerned.

FIG. 1 illustrates a representative Hall effect thruster (HET) of the type with which the present invention is concerned as it may be configured for spacecraft propulsion. HET 10 is carried by a spacecraft-attached mounting bracket 11. Few details of the HET are visible from the exterior, although the electron-emitting cathode 12, exit end 14 of the annular discharge chamber or area 16 and outer electromagnets 18 are seen in this view. As described in more detail below, propulsion is achieved by ions accelerated outward, toward the viewer and to the right as viewed in FIG. 1, from the annular discharge area 16.

Figure 2:
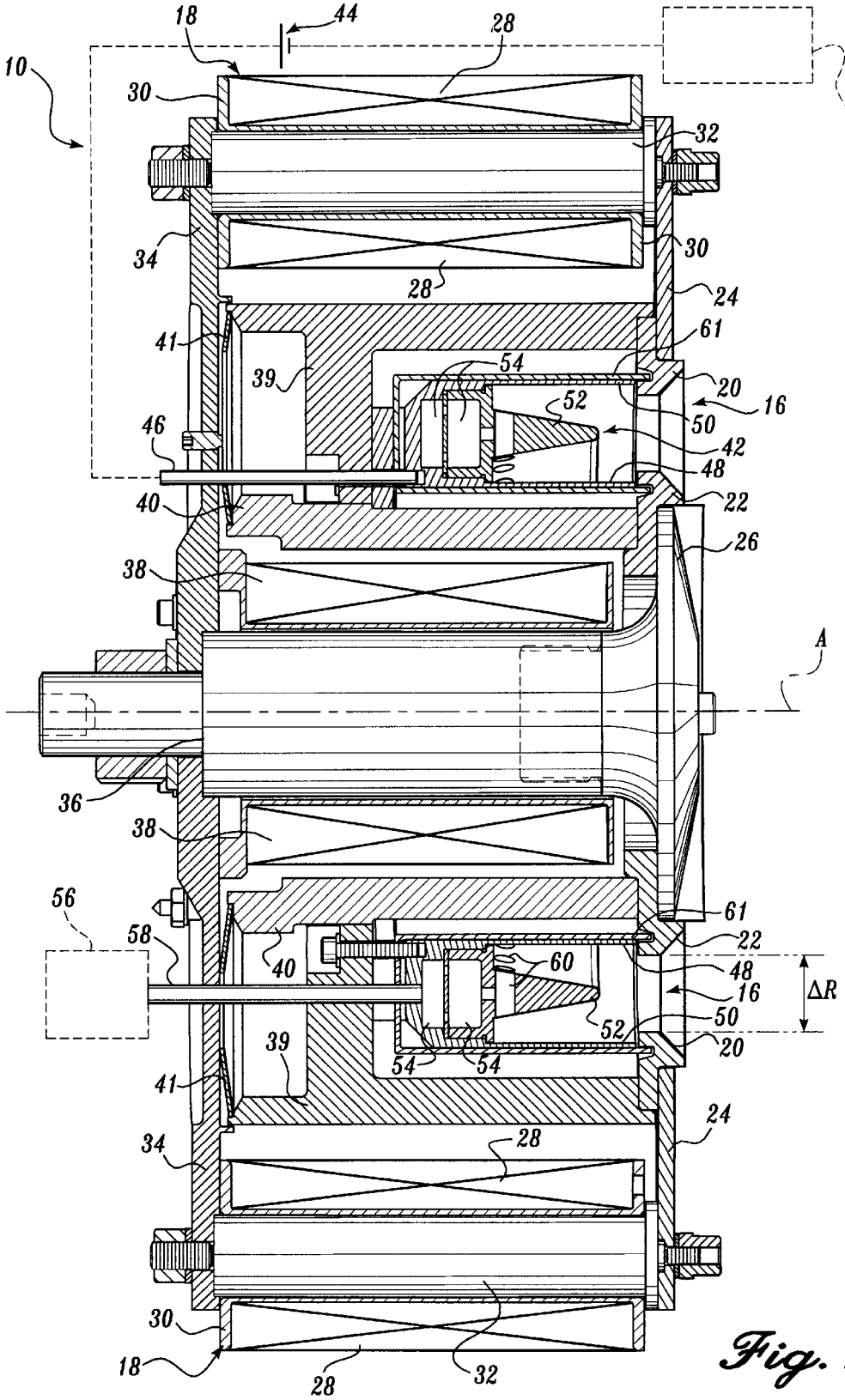
FIG. 2 is a somewhat diagrammatic longitudinal section along line 2—2 of FIG. 1.

More detail is seen in the sectional view of FIG. 2. The endless annular ion formation and discharge area 16 is formed between an outer ceramic ring 20 and an inner ceramic ring 22. The ceramic is electrically insulative, and sturdy, light, and erosion-resistant. It is desirable to create an essentially radially-directed magnetic field in the discharge area, between an outer ferromagnetic pole piece 24 and an inner ferromagnetic pole piece 26. In the illustrated embodiment, this is achieved by the outer electromagnets 18 having windings 28 on bobbins 30 with internal ferromagnetic cores 32. At the exit end of the accelerator, the cores 32 are magnetically coupled to the outer pole piece 24. At the back or closed end of the accelerator, the cores 32 are magnetically coupled to a ferromagnetic backplate 34 which is magnetically coupled to a ferromagnetic center core or stem 36. Stem 36 is magnetically coupled to the inner pole 26. These elements constitute a continuous magnetic path from the outer pole 24 to the inner pole 26, and are configured so that the magnetic flux is more or less concentrated in the exit end portion of the annular discharge area 16. Additional magnetic flux can be provided by an inner electromagnet having windings 38 around the central core 36.

Structural support is provided by an outer structural body member 39 of insulative and nonmagnetic material bridging between the outer ceramic ring 20 and outer pole 24 at one end and the backplate 34 at the other end. A similar inner structural body member 40 extends generally between the inner ring 22 and backplate 34. A Belleville spring 41 is interposed between the back ends of the structural members 39 and 40 and the backplate 34, primarily to allow for thermal expansion and contraction of the overall thruster frame.

The cathode 12, shown diagrammatically in FIG. 2, is electrically coupled to the accelerator anode 42 which is located upstream of the exit end portion of the annular gas discharge area 16 defined between the outer and inner ceramic rings 20 and 22. The electric potential between the cathode 12 and anode 42 is achieved by power supply and conditioning electronics 44, with the potential conveyed to the anode by way of one or more electrically conductive rods 46 extending through the backplate 34 of the HET 10. In the illustrated embodiment, the anode includes electrically conductive inner and outer walls 48 and 50 and an annular protruding portion 52 between the inner and outer walls. The tip of the protruding portion extends downstream close to the upstream edges of the exit rings 20 and 22.

The rear of the anode has one or more gas distribution chambers 54. Propellant gas, such as xenon, from a gas supply system 56 is fed to the chambers 54 through one or more supply conduits 58. Preferably, a series of small apertures are provided in a baffle between the fore and aft gas distribution chambers, and between the forward chamber and a series of generally radially extending gas supply apertures 60 for flow outward along the opposite sides of the protruding portion 52 of the anode toward the discharge area 16.

As discussed in more detail below, in accordance with the present invention, one more magnetically permeable element is provided, a specially designed flux bypass component 61 having circumferential sides inside the inner anode wall 48 and outside the outer anode wall 50, as well as a rear portion or web behind the anode 42 to connect the inner and outer sides of the bypass component.

In general, electrons from the cathode 12 are drawn toward the discharge area 16 by the difference in electrical potential between the cathode and the anode 42. The electrons collide with atoms of the propellant gas, forming ions and secondary electrons. The secondary electrons continue toward the anode, and the ions are accelerated in a beam directed generally outward from the discharge area, creating a reaction force which may be used to accelerate a spacecraft.

The magnetic field between the outer and inner poles 24 and 26 has several important properties, including controlling the behavior of the electrons. As electrons are drawn toward the anode, they execute a complex motion composed primarily of cyclotron motion, crossed field drift, and deflection due to occasional collisions. Electrons are considered highly magnetized in that they execute a helical motion at the so called gyro frequency $\omega_b$=qB/m which is much greater than the frequency of collisions with walls or unlike particles, $\nu_c$, where q is the electron charge, B is the magnitude of the magnetic field, and m is the mass of an electron. The ratio of the gyro frequency to collision frequency $\nu_c$ is called the Hall parameter $\beta=\omega_b/\nu_c$. Superimposed on this helical motion is a drift arising from a combination of crossed electric and magnetic fields. This drift is perpendicular to the direction of the electric field and perpendicular to the magnetic field. Since the electric field extends longitudinally and the magnetic field extends radially, the drift is induced in a generally circumferential direction in the annular discharge area 16. The electron current due to this drift is called the Hall current and is given by $$j_h = qn_e \frac{\overline{E} \times \overline{B}}{|\overline{B}|^2},$$

where $n_e$ is the electron density, $\overline{E}$ is the electric field vector and $\overline{B}$ is the magnetic field vector. The electron current perpendicular to $\overline{B}$ can be shown to be $$j_\perp = qn_e \frac{\mu_e}{\beta^2+1}\left(E_\perp + \frac{1}{qn_e}\nabla_\perp p_e\right)$$

where $\mu_e$ is the scalar electron mobility and $p_e$ is the electron pressure. The ratio of the Hall current to perpendicular can also be shown to be $$\frac{j_h}{j_\perp} = \beta.$$

The electric field for this device is generally perpendicular to the magnetic field. This arises from the mobility of electrons being different in the directions parallel vs. perpendicular to the magnetic field. Parallel electron motion is unimpeded save for collisions and electric field forces. Perpendicular motion is limited to a cyclotron orbit deflected by infrequent collisions. As a result, the ratio of parallel to perpendicular mobility is $$\frac{1}{\beta^2+1}$$

which for $\mu$=100 effectively shorts out potential variations in the direction of the magnetic field. Hence, curves defining the direction of the magnetic field approximate equipotential contours. Thus, the electric field is effectively perpendicular to the magnetic field in Hall accelerators.

Another important property is the uniformity of density and magnetic field in the drift velocity direction. For a circular accelerator, this is the azimuthal direction, i.e., generally circumferentially in the discharge area 16. Fluctuations in neutral density result in electron density variations. As the Hall current passes through regions of varying density, electrons are accelerated and decelerated, increasing motion across the magnetic field. This results in effective saturation of the Hall parameter. Variations in magnetic field strength in the drift direction have a similar effect. For instances, a 5% variation in electron density can result in an effective Hall parameter limited to a maximum of about 20.

The magnetic field strength is adjusted so that the length of the electron gyro radius, also known as the Larmor radius, $$r_g = \frac{V_\perp}{\omega_b},$$

where $V_\perp$ is the velocity component of electrons perpendicular to the magnetic field, is smaller than the radial width $\Delta R$ of the discharge area 16. The ion gyro radius is larger by the ratio of the ion mass to electron mass, a factor of several thousand. Hence, the radius of curvature of ions is large compared to the device dimensions and ions are accelerated away from the anode relatively unaffected by the magnetic field.

The magnetic field shapes the electric potential which in turn affects the acceleration of particles. A concave (upstream) and convex (downstream) shape has lens-like properties that focus and defocus the ion beam respectively. More specifically, ions tend to be accelerated in a direction perpendicular to a tangent of a line of equal potential. If this line is convex as viewed from upstream to downstream, ions are accelerated toward the center of the discharge area and a focusing effect occurs. With such focusing properties, this feature of the magnetic system is called a plasma lens.

There is a connection between the magnitude of the magnetic field measured midway between the insulator rings 20 and 22 and the electric field strength. It has been postulated that the electric field is strong beginning at some distance from the anode where the mid-channel magnetic field line has a strength of $$\frac{B}{B_{max}} = 0.6.$$

This can be considered to be the location of ion formation. See, for example, Belan et al., *Stationary Plasma Engines*, NASA Technical Translation Report No. TT-21002, October 1991, at page 210.

The general idea of the present invention is that ion formation and discharge originate on a fixed magnetic field line or curve, which also approximates a line or curve of equipotential, and that by moving and shaping this curve the ion formation and acceleration location (and direction) can be manipulated. For example, a thruster of the general design shown in FIGS. 1 and 2, but without the flux bypass component 61, was operated with different center magnet pole shapes and positions. By moving the center magnet pole downstream with respect to the outer pole, it was found that the location of erosion of the exit rings 20 and 22 moved downstream. This confirmed the hypothesis that the insulator erosion location could be moved by moving the magnetic field lines. The magnetic field lines between the magnetic poles were found to have an average angle which aims ions toward the centerline and toward the inner insulator ring, verified by the location of erosion of the inner insulator ring as compared to the location of erosion of the outer insulator ring. By adding another electromagnet coil around the center stem or core 36, it was found that the magnetic field could be adjusted to eliminate the tilt. This was confirmed by short duration tests showing that the erosion pattern of the inner and outer insulators was made even in the axial direction when the center coil was used. Current requirements for the electromagnets were kept the same by keeping the same aggregate number of ampere-turns for all of the electromagnets. A ratio of 7:3 for the total number of ampere-turns of the center coil to the total number of ampere-turns for the outer coils (all four outer electromagnets) eliminated the tilt so that both the inner and outer insulator rings eroded at the same longitudinal location, but a different ratio would be required for different thruster geometries, materials and operating parameters At any rate, the total magnetic flux created was approximately the same whether or not a center coil was used.

In order to move the discharge significantly downstream, it was found that a significant manipulation of the magnetic field was required. Initial calculations showed that by adding a U-shaped cross-section, annular ferromagnetic wrapper 61 around the anode, including the inner and outer circumferential sides, magnetic flux could be circulated around and behind the anode region. The term "flux bypass" was selected because of this characteristic. It was also found that the line with the peak magnetic field ($B_{max}$) was moved downstream and that the position of the line at a given proportion of this strength, such as 0.6 where it had been postulated that ion formation occurs, was both moved downstream and closer to the $B_{max}$ line. The flux bypass steepens the axial gradient of the magnetic field strength in addition to pushing the $B_{max}$ location farther downstream. Because the ion formation and discharge is located farther downstream, the thruster can operate for longer periods before it erodes through the magnetic poles. The net result of the field manipulation was that it increased the life of the thruster by a factor of two or more.

More specifically, tests were conducted for an HET of the general design shown in FIGS. 1 and 2, having a mid-channel radius as measured from the centerline A of 41 mm and a radial width ΔR between the exit rings of 12 mm. The axial length of the insulator rings 20 and 22 along their facing surfaces was 12 mm, including the outer beveled portion, and the radial width of each insulator ring was 6 mm at a location aligned with the adjacent magnet pole piece. The ratio of ampere-turns for the four outer coils and the center coil was as given above, with sufficient current to achieve a maximum field strength of about 690 Gauss as measured along the exposed, outer longitudinal side of the inner insulator ring 22. The power supply and conditioning electronics provided a potential of 350 volts, 1.7 kilowatts, between the cathode 12 and anode 42. Xenon gas was supplied through the hollow anode at a rate of 5.4 mg/sec. The magnetic field strength was measured with and without a magnetic shunt 61 having solid sheet cylindrical inner and outer sides surrounding the inner and outer walls 48, 50 of the anode, and projecting part way into the insulator rings 20, 22 as shown in FIG. 2. In accordance with the present invention, the back of the shunt was formed by radial ribs with large openings between the ribs to control the reluctance of the path from the outer side of the shunt to the inner side of the shunt.

Figure 3:
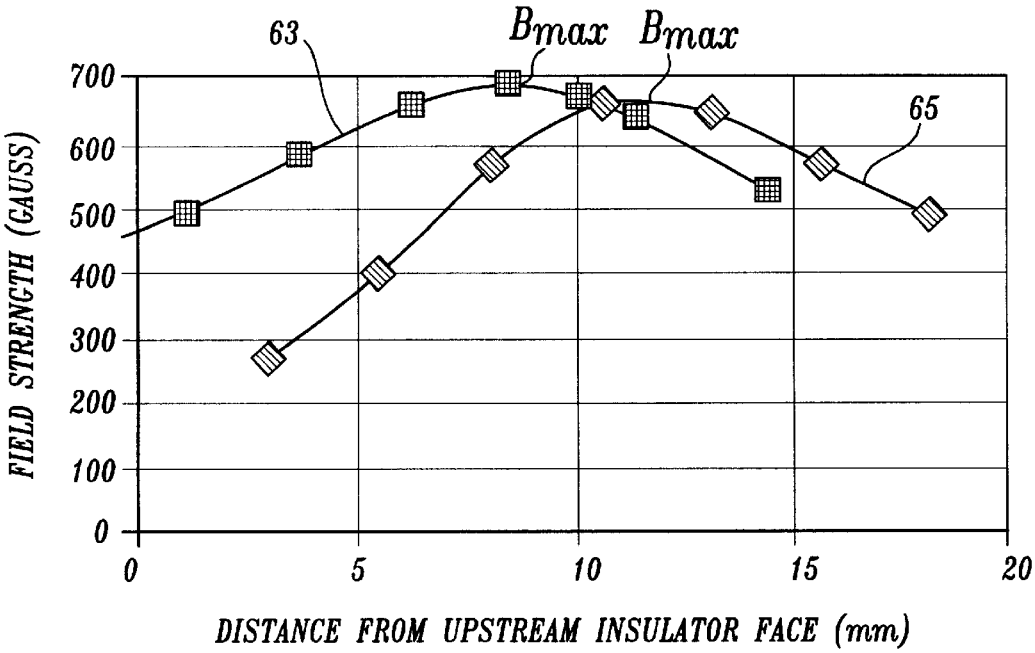
FIG. 3 is a graph illustrating the effect of a flux bypass component on the magnetic field profile in an accelerator of the type with which the present invention is concerned.

Line 63 in FIG. 3 shows the shape of the magnetic field as measured from the upstream edge of the inner insulator ring with no magnetic flux bypass component in place. Line 65 in FIG. 3 shows the profile of the magnetic field when a flux bypass component with solid sheet inner and outer walls connected together behind the anode was applied. As illustrated in FIG. 3, the magnetic flux gradient is increased substantially by use of the flux bypass component, and the location of maximum magnetic field strength is moved farther downstream.

Figure 4:
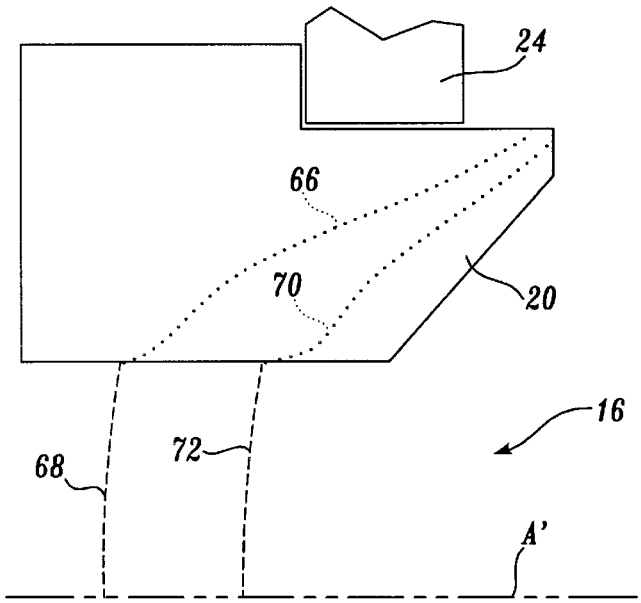
FIG. 4 is an enlarged, diagrammatic, fragmentary section of the ion exit end of an accelerator of the type with which the present invention is concerned.

Erosion of the insulator rings was measured at different stages of the testing. With reference to FIG. 4 (an enlarged, fragmentary, diagrammatic view of the downstream end portion of the outer insulator ring 20 and adjacent magnetic pole piece 24, outward from the centerline A' of the discharge channel 16) the erosion profile when no bypass component was used is indicated by line 66, which corresponds to ion formation upstream of line 68 in discharge area 16. By adding the flux bypass component of the type described above, the erosion profile moved to line 70 of FIG. 4, corresponding to ion formation upstream of line 72, much farther downstream than for the HET with no flux bypass cage.

Figure 5A:
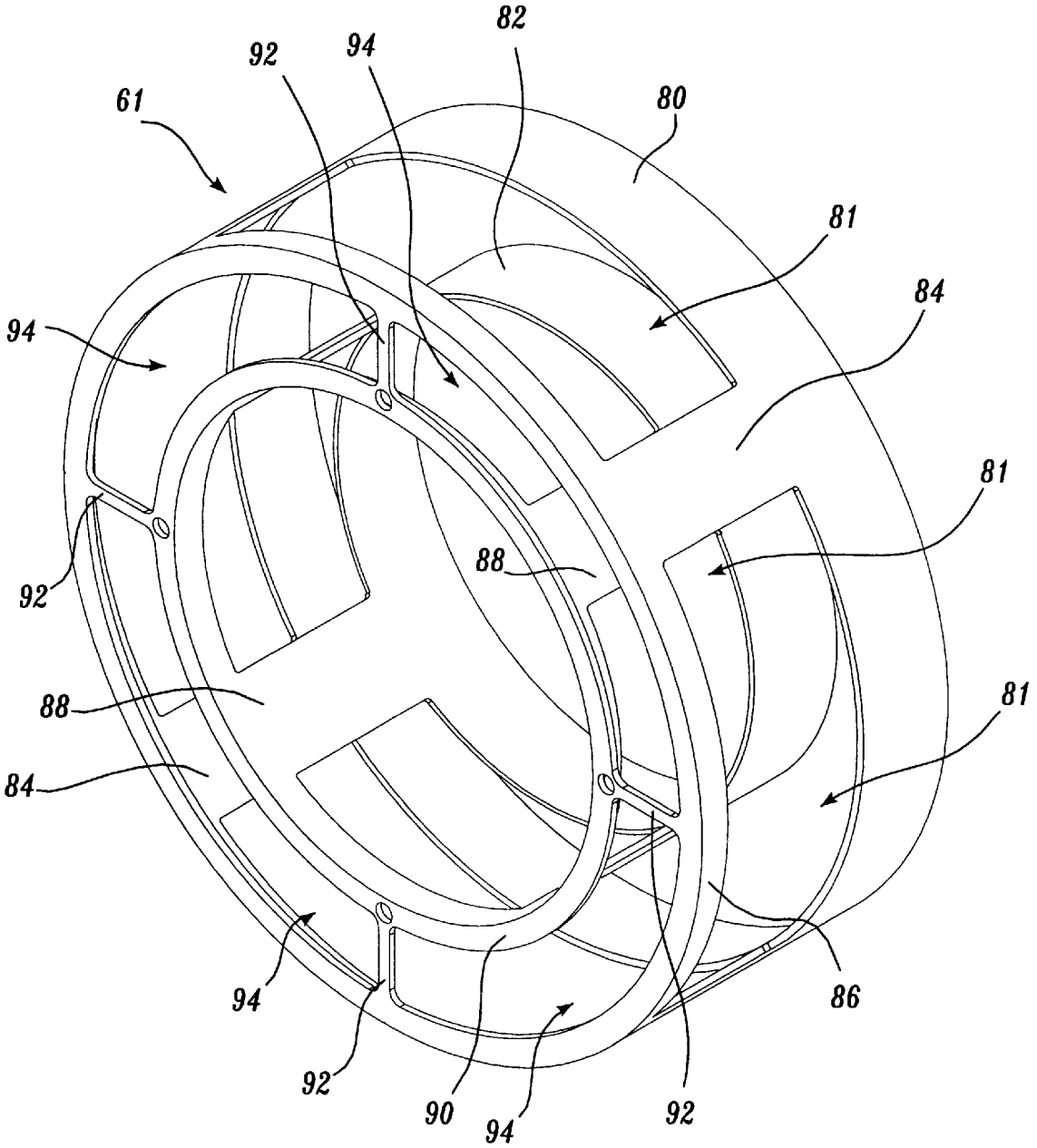
FIG. 5A is a top, rear perspective of a first embodiment of a flux bypass cage in accordance with the present invention for use in an ion accelerator with closed drift of electrons.
Figure 5B:
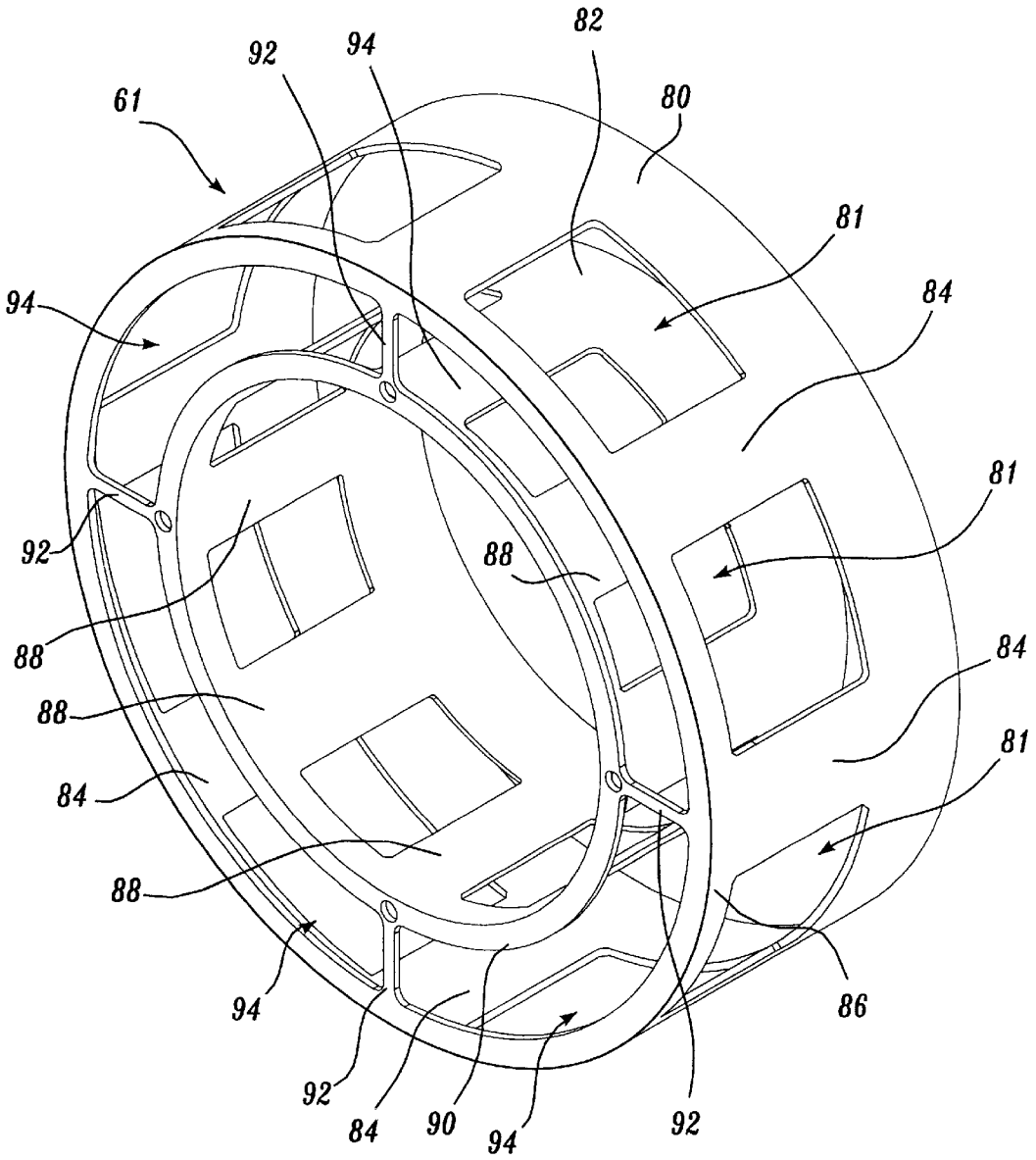
FIG. 5B is a top, rear perspective of a second embodiment of a flux bypass cage in accordance with the present invention for use in an ion accelerator with closed drift of electrons.
Figure 5C:
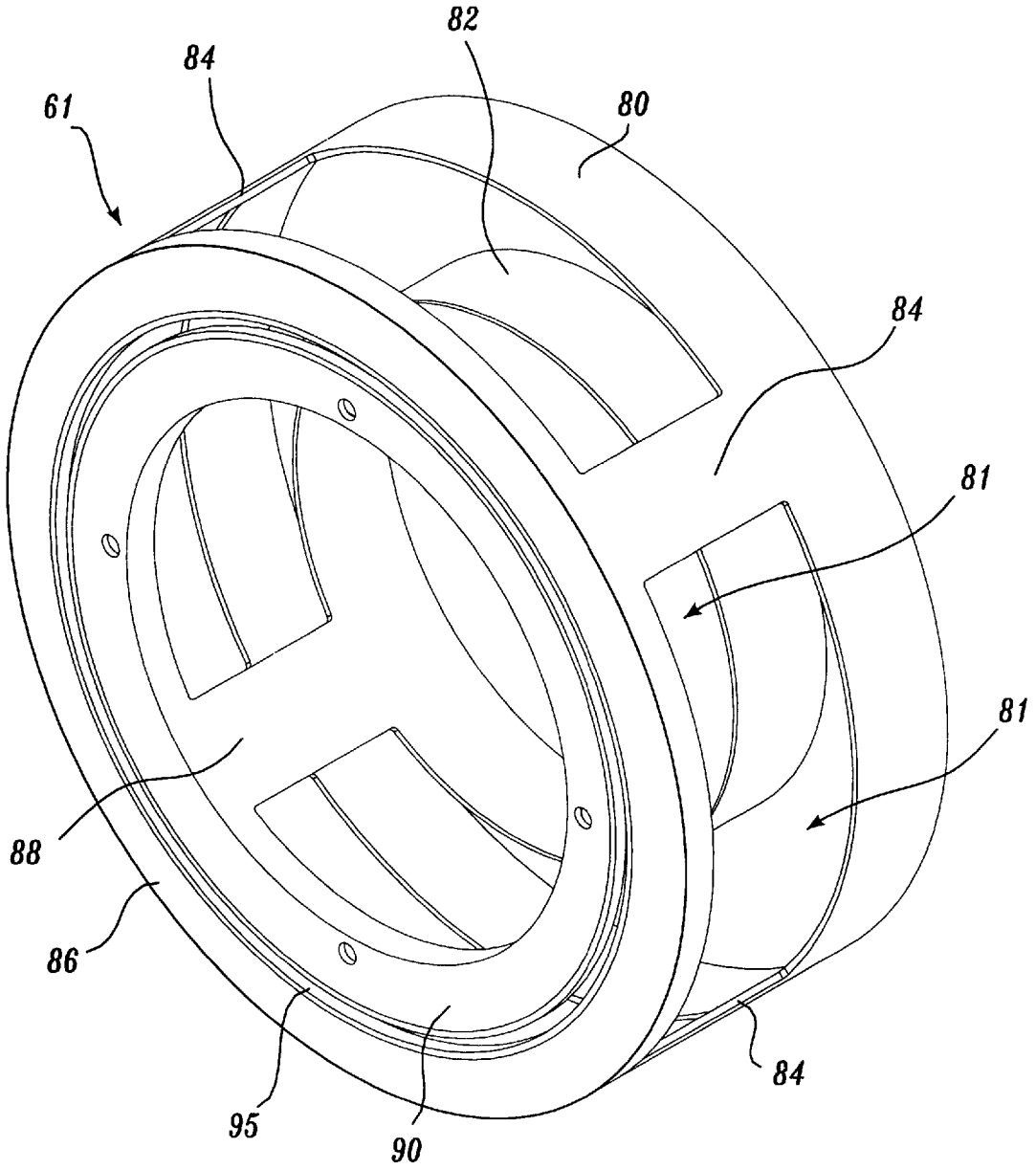
FIG. 5C is a top, rear perspective of a third embodiment of a flux bypass cage in accordance with the present invention for use in an ion accelerator with closed drift of electrons.
Figure 5D:
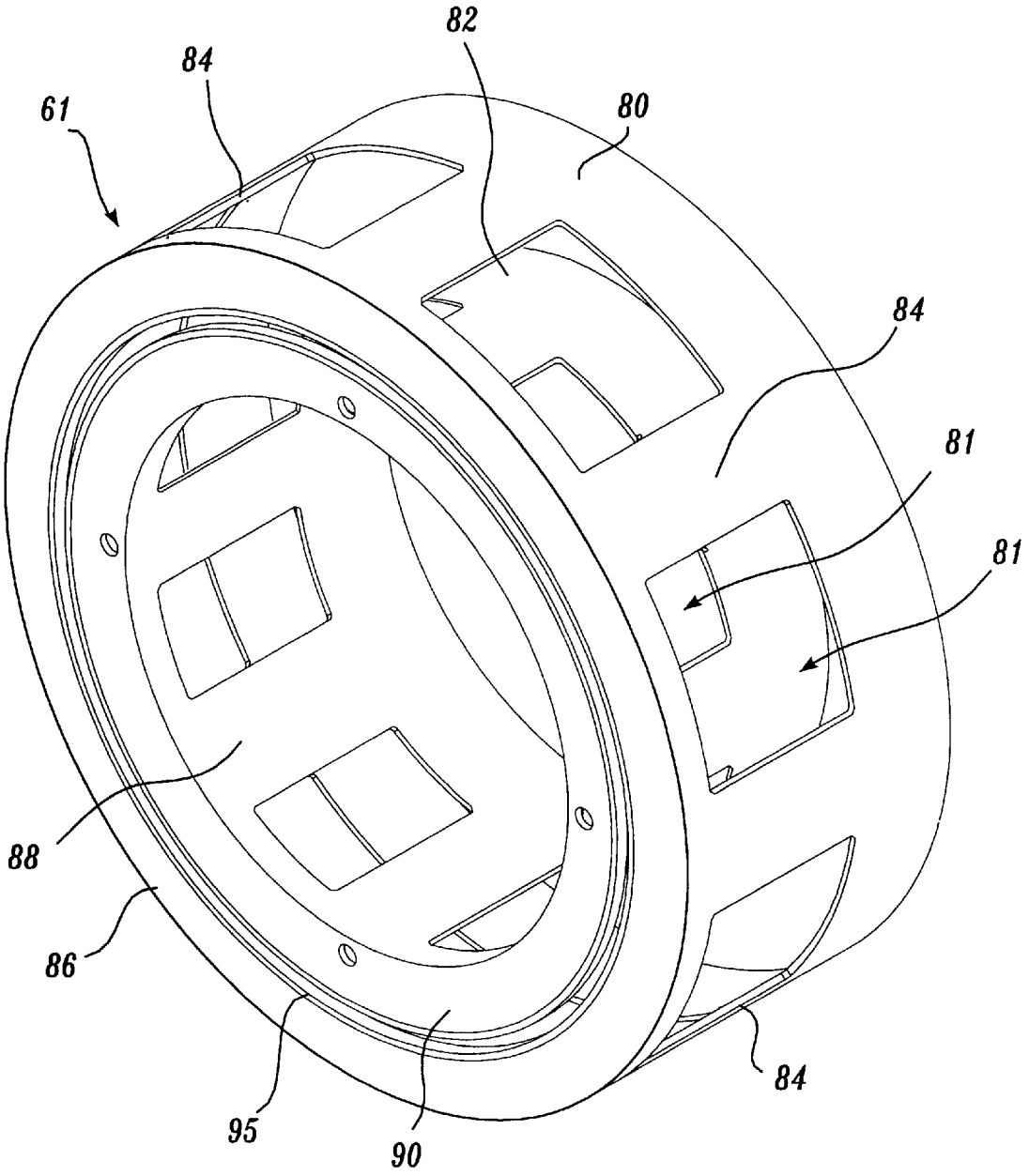
FIG. 5D is a top, rear perspective of a fourth embodiment of a flux bypass cage in accordance with the present invention for use in an ion accelerator with closed drift of electrons.

In accordance with one aspect of the present invention, a bypass shunt is formed with large openings in either or both of the sides and inner connecting end (behind the anode) of the shunt body to form a cage, as illustrated in FIG. 5A and FIG. 5C. The cage 61 fits around the anode housing so that the open rings 80 and 82 at the exit end are embedded in the ceramic insulator rings. More specifically, as shown diagrammatically in FIG. 6, the outer exit end or downstream ring 80 is embedded in the inner face of the outer insulator 20, and the inner exit end or downstream ring 82 is embedded in the inner face of the inner insulator 22. The side openings 81 can encompass much more than the major portion of the circumferential area of the cage. In the embodiments illustrated in FIG. 5A and FIG. 5C, four thin strips 84 of magnetically permeable material connect the outer exit end or downstream ring and a similar outer upstream ring 86 at the rear or closed end of the cage. Strips 84 are radially aligned with similar strips 88 extending between the inner exit or downstream ring 82 and a corresponding inner upstream ring 90 at the opposite end of the cage. The strips can be disposed at 45° from the four outer electromagnets to allow more flux to pass through the open sides of the cage. In the embodiments of FIGS. 5A and 5B, the magnetic path between the outer rings and the inner rings is completed by short radial spokes 92 extending between rings 86 and 90 at the closed end of the cage, behind the anode. The large openings 94 at the closed end allow propellant and power lines to feed directly into the anode. Although four strips 84, four strips 88, and four ribs or spokes 92 are shown, larger numbers can be used, preferably with uniform spacing, as illustrated in FIGS. 5B and 5D, to achieve a desired reluctance of the magnetic path defined by the cage. In the embodiments of FIGS. 5C and 5D, reluctance of the rear portion of the cage is controlled by the width of an annular gap 95 between the rear end or upstream rings 86 and 90 which have a greater radial dimension than the corresponding rings of the embodiments of FIGS. 5A and 5B. Nevertheless, the inner and outer upstream rings are magnetically coupled across the gap.

Figure 7:
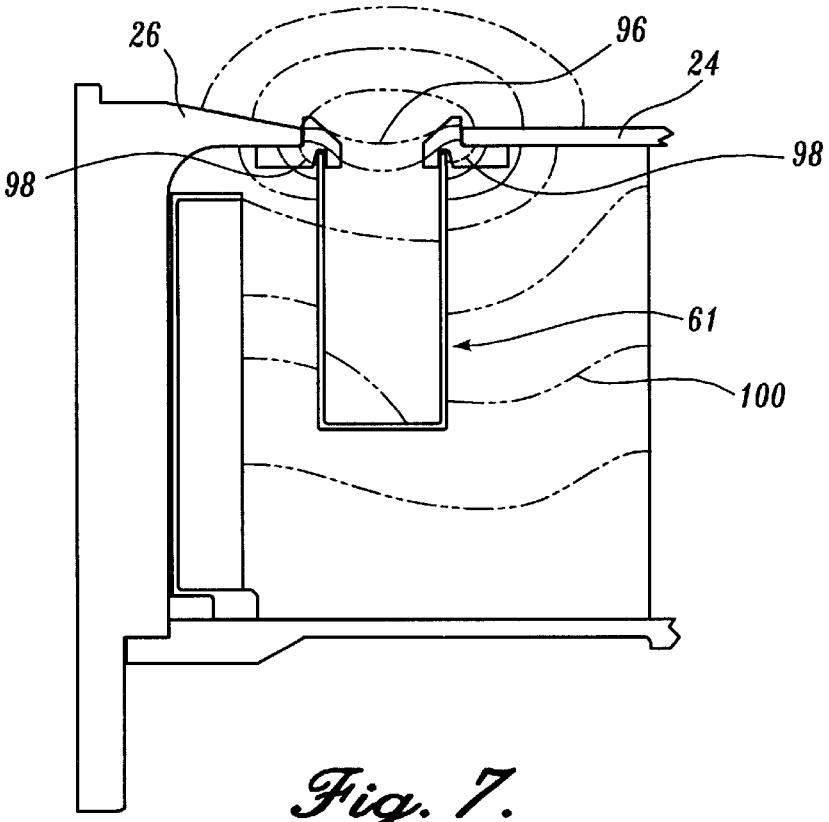
FIG. 7 is a diagrammatic partial section of an accelerator of the type with which the present invention is concerned illustrating magnetic field lines and paths.

One major advantage of the open cage design versus the solid wall bypass is that it reduces the ampere-turn requirements and the thruster weight. In a typical closed drift accelerator with a flux bypass, there are three major paths as illustrated in FIG. 7. The first flux path 96 shows magnetic flux lines crossing the radial gap between the magnet poles 24 and 26. The second flux path 98 connects the inner pole 26 to the inner corner of the flux bypass cage 61 and from the outer corner of the bypass cage to the outer pole 24. The third path 100 connects to the middle of the flux bypass from the inner and outer magnet structure. The weight and ampere-turn savings with the open cage design are achieved by increasing the average reluctance of paths 98 and 100 which increases the percentage of the total flux passing across path 96. Compared to a solid wall screen which encloses the anode and the mid-stem, the predicted flux through path 100 is 30–40% less and through path 98 is 15–25% less.

Figure 8:
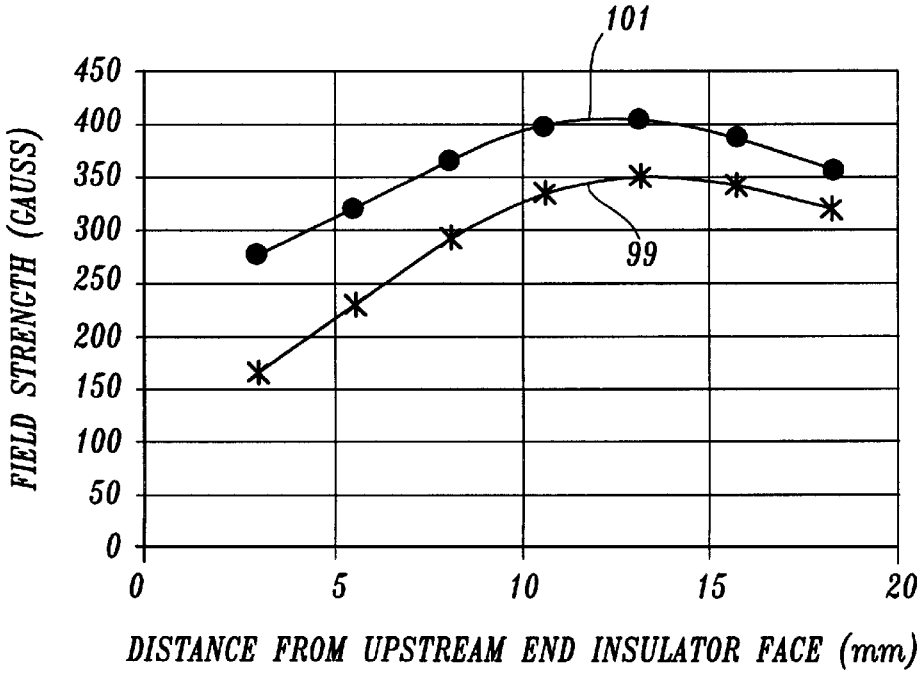
FIG. 8 is a graph illustrating the effects of different bypass components on the magnetic filed strength and profile in a ion accelerator with closed drift of electrons.

FIG. 8 shows the field strength in the mid-channel of the discharge area 16 for a solid flux bypass component (line 99) and one version of the open cage design (line 101). These data were obtained with Gaussmeter measurements performed on a laboratory accelerator design of the type shown in FIGS. 1 and 2 having the following parameters: Mid-channel radius as measured from the thruster centerline, 65 mm; radial width ΔR between the exit rings, 18 mm; axial length of the insulator rings along their facing surfaces, 15 mm; radial width of each insulator ring at a location aligned with the adjacent magnetic pole piece, 8 mm; power supply and conditioning electronics providing a potential of 350 volts, 4 kilowatts; xenon gas supplied through the hollow anode at a rate of 12.8 mg per second. The abscissa in FIG. 8 is the axial distance along the outer insulator ring 20. Zero is taken as the point farthest upstream along the insulator. In each instance, erosion of the insulator began at about 4.5 mm from the upstream edge. For the open cage design, this corresponds to a magnetic field strength at mid-channel of about 0.85 of the maximum, i.e., 0.85 $B_{max}$ Also, the location of the mid-channel $B_{max}$ curve is downstream of the magnet pole pieces in each instance. The measurements show that for a given number of ampere-turns the field strength is about 15% higher in the mid-channel with the open cage design because a larger percentage of the total flux passes across the radial gap between the poles. Reduction in the total flux required is particularly advantageous for spacecraft applications where minimum mass is important. The ferromagnetic conductor and electromagnetic coil weight are driven by the flux capacity needs as opposed to structural support requirements. Therefore, any reduction in total flux results in a significant weight savings.

Figure 9:
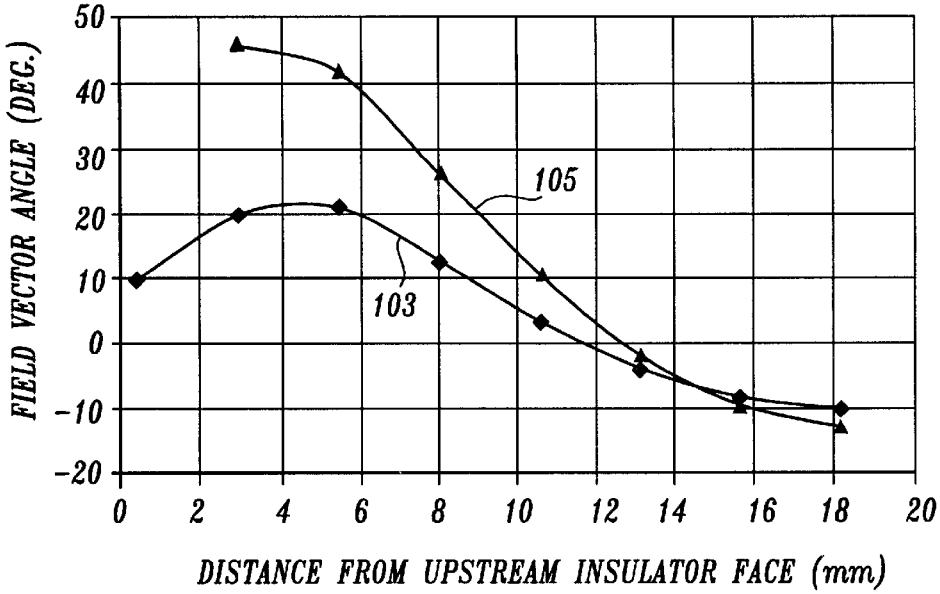
FIG. 9 is a graph illustrating magnetic field vector angles for different bypass components in an ion accelerator with closed drift of electrons.

Another feature of the cage design is that it gives the designer control over the shape of the magnetic field vectors in the discharge channel. By adjusting the thickness and width of the cage bars, the angle the magnetic field streamlines make with the inner and outer insulators can be increased or decreased. For example, FIG. 9 shows the angle changes achieved at the outer insulator ring 20 for a completely solid sidewalls and essentially open back cage (line 103) and one with openings in the sides as shown in FIG. 5A (line 105). The physical parameters of the thruster were the same as those described above with reference to FIG. 8. The x-axis dimension is the distance along the outer insulator ring. Zero is taken as the point farthest upstream along the insulator. In this case, the angle has been decreased by 50% along the outer insulator ring. The point at which the field lines have no axial component has been moved downstream by approximately 1 mm. Adjusting the magnetic field shape controls the plasma dynamics and insulator erosion, particularly the convergence and divergence of the ion stream. As discussed above, the shape of the field lines strongly influences the shape of the equipotentials and therefore the location of formation of ions and the direction of acceleration. The proper field vector angle along the insulator rings will direct the ions away from the walls and reduce erosion. Therefore, control over this parameter allows one to increase the life of the thruster. The shape of the field lines can also be controlled by modifying the shape of the exit end rings 80 and 82 and adjusting ΔR, the radial distance between the insulator rings.

There are other factors that affect the contour of the magnetic field lines and, therefore, magnetic field vector angles and ion beam divergence or convergence. Electric potentials are set by boundary values and gradients are controlled by the motion of electrons along and across the magnetic field lines. The power supply sets the difference between the anode and cathode potentials. For the magnetized plasma in a Hall accelerator, electric potential differences are small along magnetic lines of force. The small potential differences correspond to the relatively free motion of electrons in the direction of a magnetic field line. For the case where magnetic field lines intersect an insulating surface, electric potential gradients are governed by electron mobility. Because electron mobility across field lines is low, high electric potentials develop across magnetic field lines to push electrons toward the anode. In the case where magnetic field lines intersect a conducting surface, such as an iron magnet pole for downstream magnetic field lines, the electric potentials on these field lines approach the voltage of the iron. In other words, the iron sets the boundary voltage for intersecting field lines. Effectively, all these magnetic field lines obtain a common electric potential. Hence, the iron shorts out the potential differences for the region of field lines that directly intersect the uninsulated surface. One result for thruster geometries of the type with which the present invention is concerned is that the electric field is strongest upstream of the $B_{max}$ line so that most ion acceleration occurs in this area. For downstream locations, the magnetic field lines intersect the magnetic poles, creating a zone of little or no acceleration. In accordance with the present invention, this effect can be lessened by applying an insulative coating over the exposed surfaces of the poles.

Comparison of erosion profiles for insulated and uninsulated pole pieces shows that erosion locations are more favorable, i.e., more downstream, when an insulating coating is applied to the magnet pole pieces. The best mode for the accelerator in accordance with the present invention uses a magnetic field at mid-channel diameter that peaks downstream of the magnetic pole face, preferably by 1 to 10 mm. The pole face may be insulated by a variety of materials. Using a plasma sprayed nickel coating on the ferromagnetic pole enables excellent adhesion of a plasma sprayed aluminum oxide insulating coating of a thickness of about 0.5 mm. The coating rather than a separate sheet of insulating material improves the thermal radiation from the magnetic pole piece, which is highly desirable for spacecraft propulsion applications.

Summarizing important aspects of the present invention: operation of the improved accelerator consists of achieving a high thrust efficiency and at the same time a long operating life. There are three general aspects of the magnetic field which must be controlled for improved operation, strength, axial gradients, and magnetic field shape.

Figure 10:
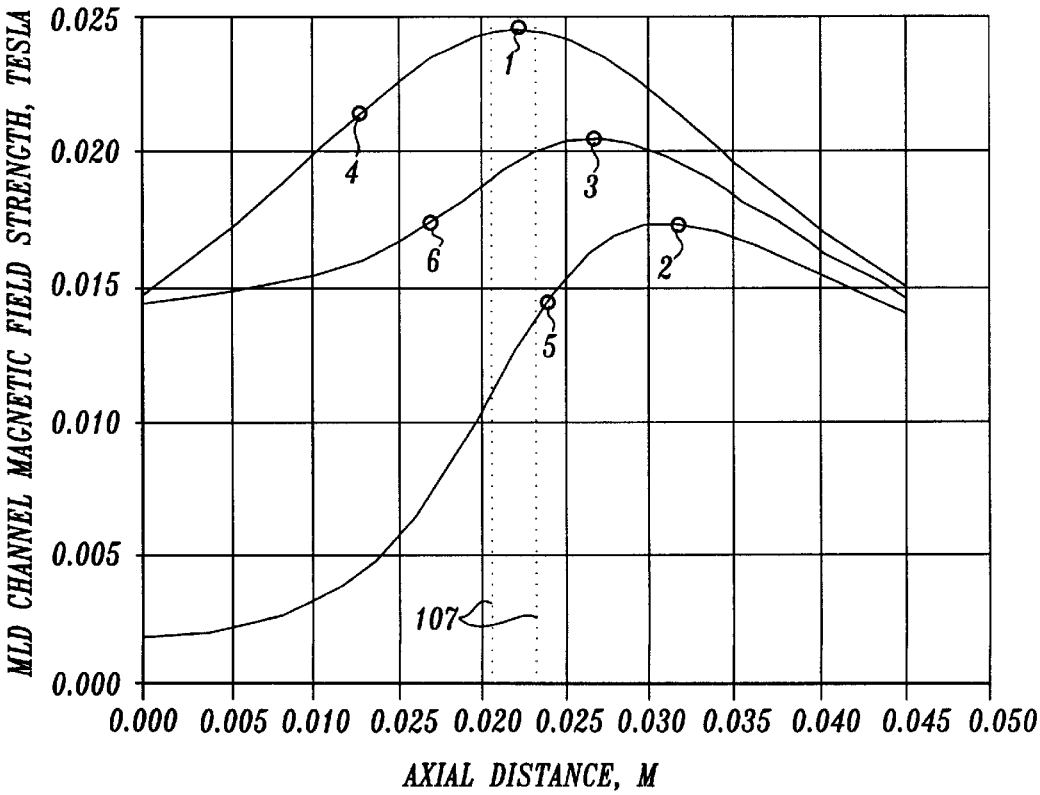
FIG. 10 is a graph illustrating the effects of different bypass components on the magnetic field strength and profile in an ion accelerator with closed drift of electrons.

The long life is obtained by moving key features of the magnetic field summarized in FIG. 10 which shows the strength of the magnetic field along a line at a mid-channel of the discharge area between the exit rings. Magnetic field calculations are performed with conventional computer automated design tools such as EMAG by Engineering Mechanics Research Center Corporation. This is a finite element solver that provides close agreement with measured magnetic fields. These calculations use the physical and operational thruster parameters described with reference to FIG. 8.

The points labeled 1, 2, and 3 in FIG. 10 are in order: the maximum magnetic field strength at mid-channel, $B_{max}$, for a magnetic system with no flux bypass (point 1); with a solid flux bypass (point 2); and with a cage flux bypass (point 3). These points indicate specific flux lines on the two-dimensional magnetic field calculations for FIG. 11 which represents no flux bypass, FIG. 12 which represents a flux bypass component with solid sides, and FIG. 13 which represents a flux bypass component with openings in the sides.

Using a flux bypass cage, the peak magnetic field is shifted downstream. Without a flux bypass cage, $B_{max}$ occurs near the axial midpoint of the poles. For points 2 and 3, note that the maximum magnetic field strength occurs downstream of the magnet poles, whose axial extent is between the dashed lines 107 on FIG. 10.

Figure 12:
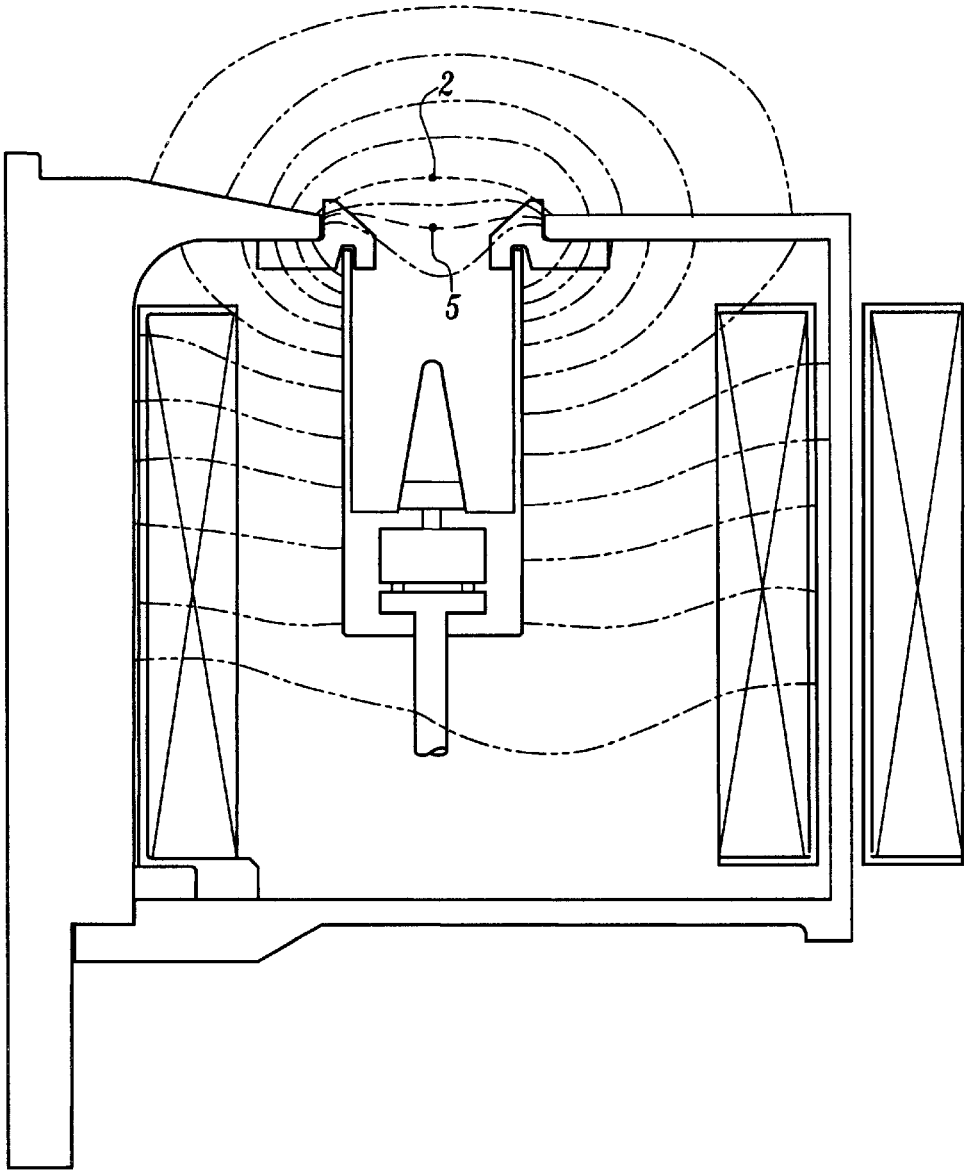
Figure 13:
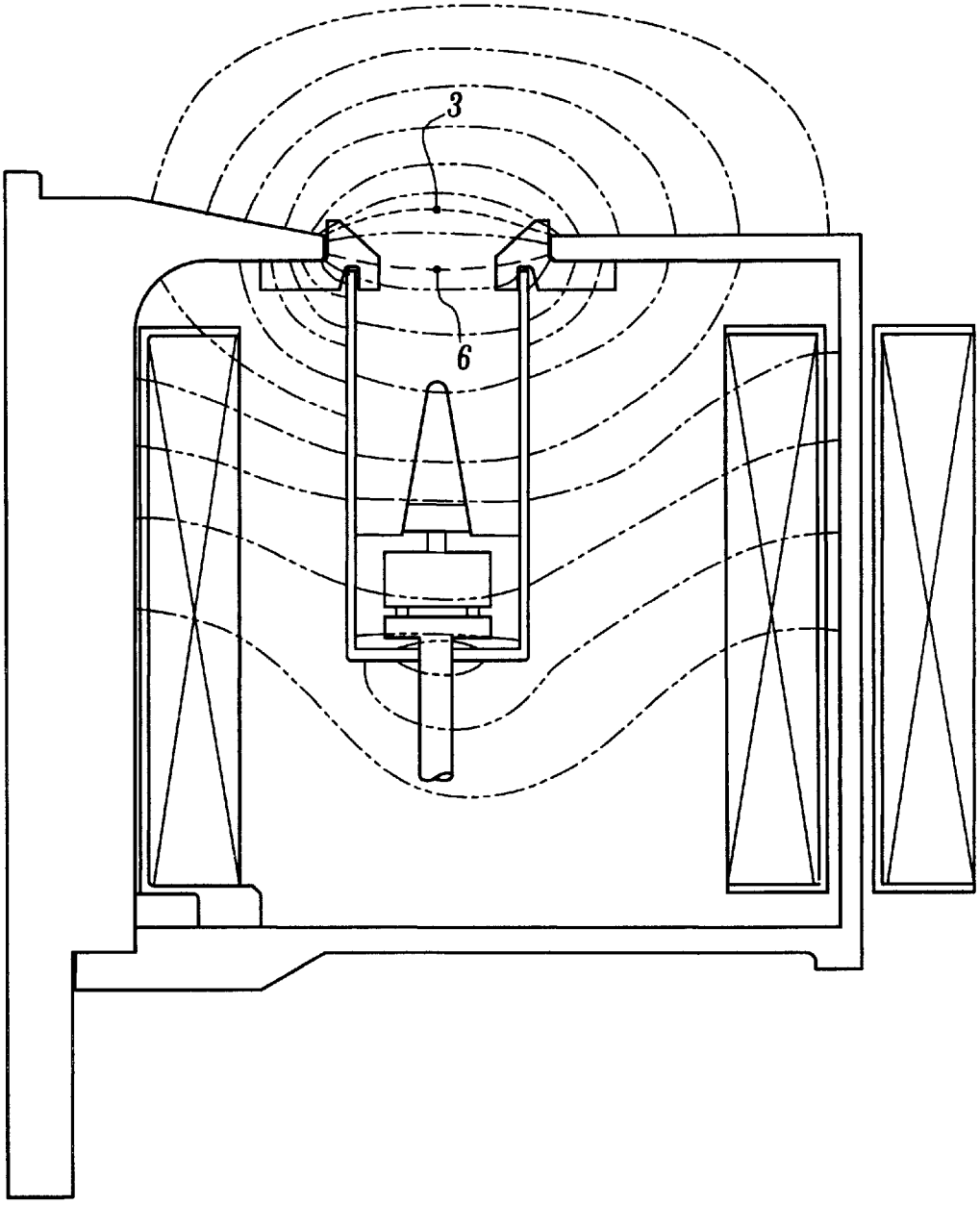

Next, consider the points representing the location of 0.85 $B_{max}$ labeled points 4, 5, and 6 in FIG. 10, which, based on erosion patterns for the prototype described with reference to FIG. 8, is the approximate location of ion creation for the improved thruster in accordance with the present invention. These points correspond to specific two-dimensional magnetic field lines as noted by points 4, 5, and 6 in FIGS. 11 (no bypass), 12 (solid-sided bypass cage), and 13 (bypass cage with open sides), respectively. Again, by using a flux bypass cage the 0.85 $B_{max}$ location is shifted downstream compared to the case without a flux bypass cage. For our device, the magnetic flux line passing through 0.85 $B_{max}$ is experimentally determined to correspond to the beginning of the erosive part of the discharge, i.e., the most upstream location of insulator erosion. Hence, moving the location of this strength of magnetic field has been shown to change the location of the erosive portion of the discharge. Comparing the mid-channel, axial location of points 4 and 5, we see that by using a solid flux bypass cage (FIG. 12), the erosive part of the discharge may be moved downstream. The axial location of point 5 may be adjusted by changing the axial position of the flux bypass cage. Moving the bypass downstream moves points 2 and 5 downstream in some proportion. With reference to FIG. 13, this same general effect holds for the flux bypass cage (open sides)—moving the cage farther downstream moves points 3 and 6 farther downstream. However, the locations of points 3 and 6 differ from the solid-sided bypass due to field line shape and degree of flux bypass differences.

Figure 11:
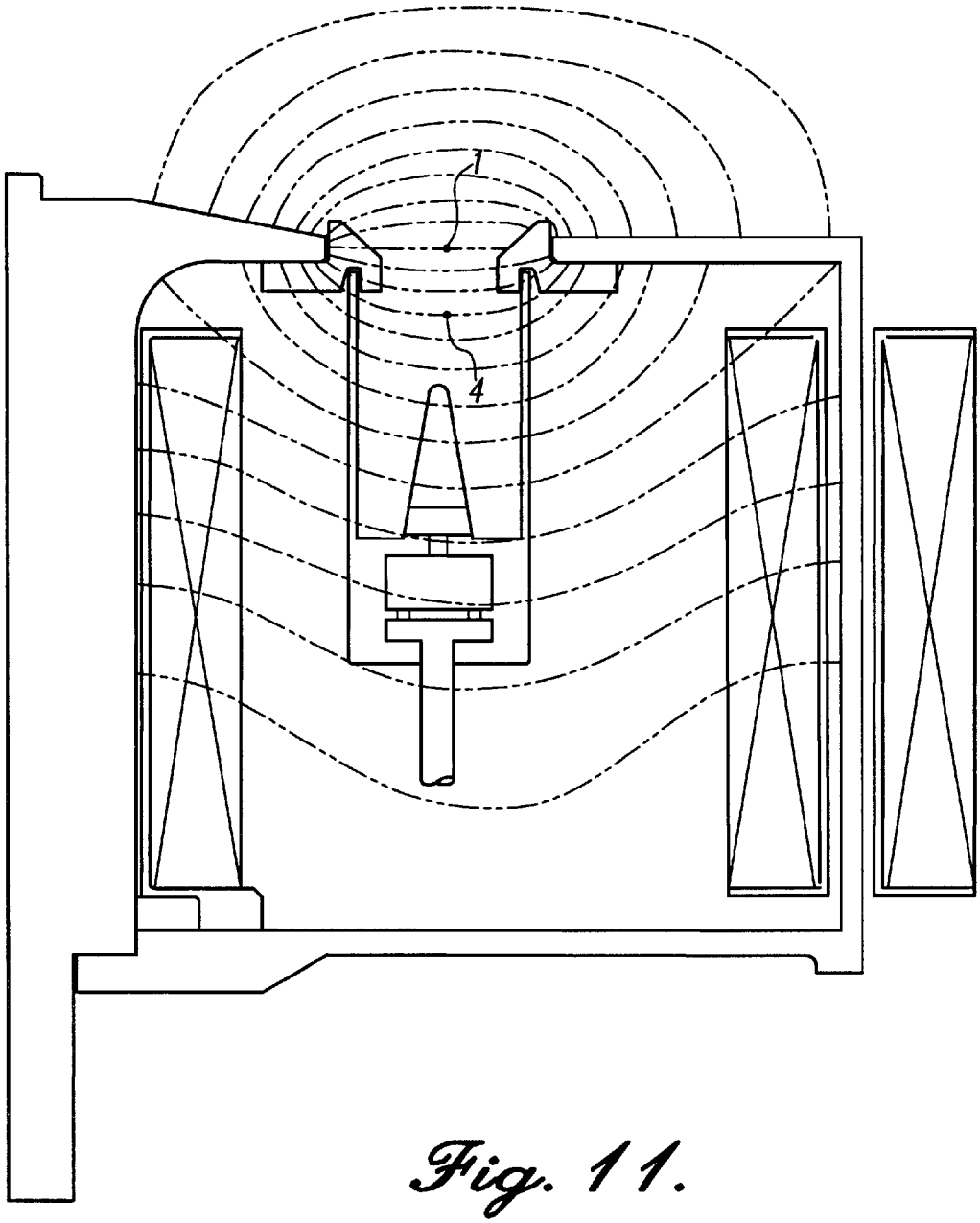
FIGS. 11, 12, and 13 are corresponding diagrammatic, fragmentary, sectional views of an accelerator of the type with which the present invention is concerned illustrating magnetic and electric field lines and paths.

The shape or contour of the magnetic field lines affects the focusing of the plasma lens. This focusing has a primary effect on the efficiency. In FIG. 11 (no bypass), the magnetic field line labeled 4 has a radius of curvature of approximately 80 mm. This is the 0.85 $B_{max}$ location. When a solid-sided flux bypass is used, represented in FIG. 12, the radius of curvature is approximately 20 mm on the magnetic field line labeled 5 (0.85 $B_{max}$). With the flux bypass cage having openings in the sides, represented in FIG. 13, the radius of curvature of field line 6 (0.85 $B_{max}$) is approximately 40 mm. Also note that field line 6 in FIG. 13 intersects the insulator walls at the location which effectively becomes a corner dividing eroded from uneroded insulator.

Using a flux bypass cage of varying open area, the focusing properties of the magnetic lens can be changed without significant relocation of the erosion corner. Adjusting the aggregate cross sectional area of the radial spokes at the rear or upstream portion of the cage (behind the anode) changes the amount of flux bypassing the anode region and affects the curvature of the field line labeled 6 in FIG. 13.

By measuring the distribution of ion current vs. position well downstream of the accelerator, the degree of plume divergence may be determined. For accelerators with plasma lens characteristics like those shown in FIG. 12, we find higher divergence than for lens characteristics of FIG. 13 for a 350 V discharge. Thus, the longer focal length of the magnetic lens in FIG. 13 provides improved plume properties from the standpoint of divergence angle.

The peak magnetic field strength at mid-channel is also affected by the amount of flux bypassing the anode region. The curves in FIG. 10 represent mid-channel magnetic field strengths for a coercive force of 1,000 ampere-turns. Assuming the magnetic field in the primary magnetic circuit does not saturate the permeable elements, the maximum field strength for each case is approximately proportional to the coercive force. To increase the strength of point 2 to equal point 1, the coercive force for the solid shunt configuration must be increased by the ratio of the magnetic field of point 1 over point 2 or 42%. The flux bypass cage requires only a 20% increase in coercive force to achieve the same peak magnetic field as point 1. The reduction in the number of ampere-turns for an accelerator used as a spacecraft thruster can have a useful decrease in weight of the magnetic system.

The cage design is also advantageous from a thermal standpoint. One of the drawbacks of shields which are separate from but enclose the anode and mid-stem is that they inhibit radiative cooling of the anode. Radiative cooling decreases the heat conduction to the spacecraft and allows the mid-stem to operate at cooler temperatures which increase its flux capacity. Also, the reduced ampere-turn requirement for the cage type flux bypass reduces the ohmic power dissipated in the coils. These reductions in heat dissipation and increases in radiative cooling lessen the need for thermal shunts to conduct heat away from the core of the thruster.

Figure 6:
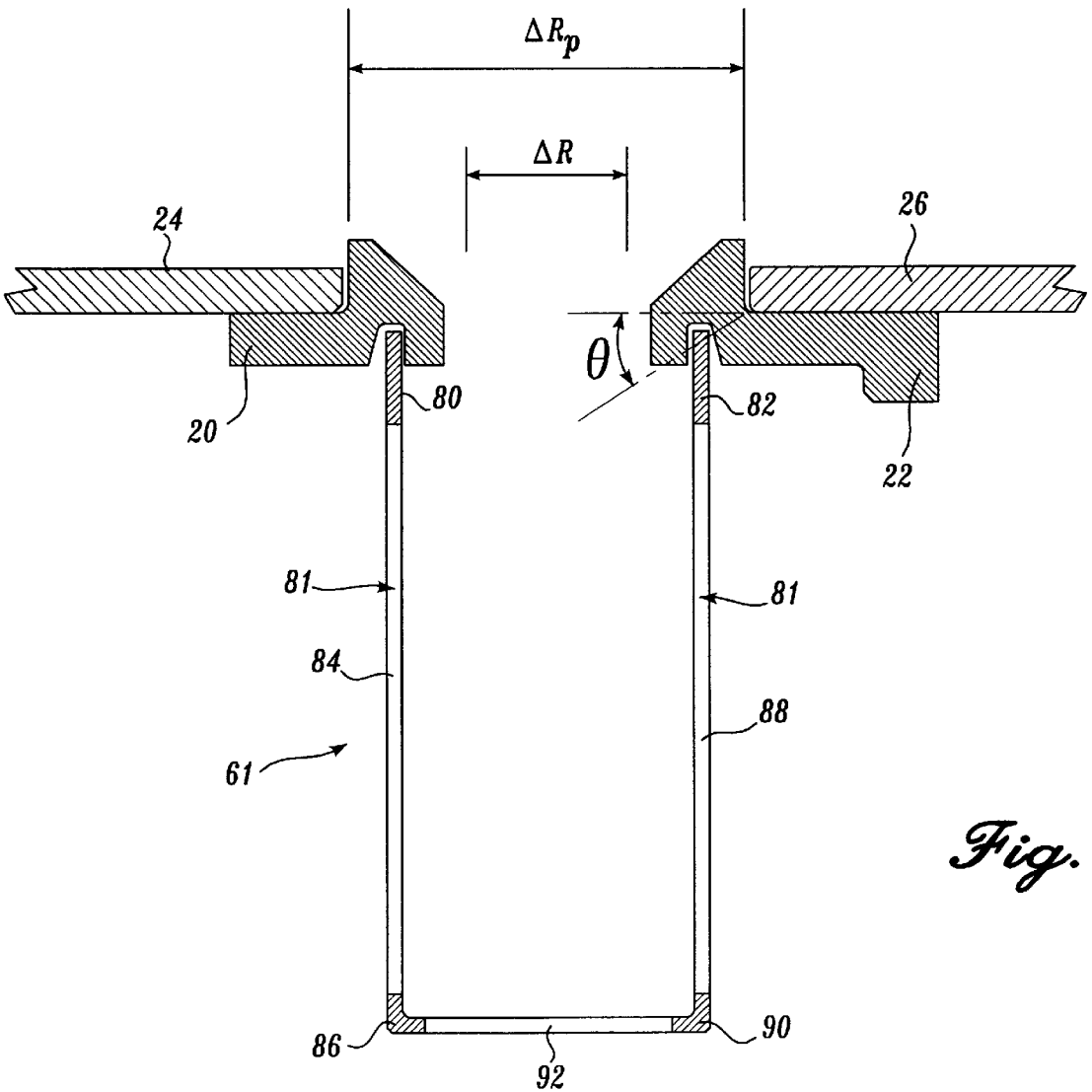
FIG. 6 is a very diagrammatic partial sectional view of an accelerator having a flux bypass cage in accordance with the present invention.

Based on experiments and calculations to date, it is difficult to specify the optimum physical characteristics for the flux bypass cage and its positioning relative to the insulator rings and magnetic pole faces. Nevertheless, some preferred relationships have been observed in order to achieve the desired aspects of the magnetic field shaping, including positioning of the field line of maximum strength ($B_{max}$), magnetic field strength gradient (primarily the location of the 0.85 $B_{max}$ line), total coercive force required to achieve the desired maximum field strength, and curvature of the magnetic field lines to achieve focusing for increased efficiency. With reference to FIG. 6, one important parameter is the angle $\theta$ between a radial line at the upstream edge of the inner magnetic pole piece 26 and a line from the inner upstream corner of the pole piece to the adjacent corner of the bypass cage. The most favorable results have been achieved when $\theta$ is approximately 45°, and desirable results are observed and calculated for $\theta$ within the range of 20° to 80°. If the angle is too great, the spacing of the bypass cage from the magnetic poles doesn't achieve a sufficient bypass of magnetic flux, whereas for $\theta$ less than 20°, the magnetic field strength is reduced at mid-channel to a point where more total coercive force is required to achieve a desired strength.

Another important aspect is the reluctance of the coupling of the inner side of the cage to the outer side of the cage, which can be adjusted by the quantity of magnetic material joining the inner and outer sides. Currently, the best results have been observed when the open area of the rear or upstream end of the cage is approximately 97% of the total area, i.e., only a few thin radial spokes are used to connect the inner side of the cage to the outer side of the cage. The same effect could be achieved by an embodiment in accordance with FIG. 5B where the gap 95 is very narrow. At any rate, it is believed that at least the major portion, and preferably more than 90%, of the rear or upstream end of the cage be open between the inner and outer cage sides.

Another aspect is the amount of open area in the sides of the cage. The best results to date have been obtained when the side openings encompass the major portion of the circumferential area, permitting flux to pass through the openings and reducing the total coercive force required.

Concerning the focusing-defocusing effect of the bypass cage, best results have been achieved for the prototype described with reference to FIG. 8 when the radius of curvature of the 0.85 $B_{max}$ line is about 40 mm. This corresponds to about 0.85 of the distance $\Delta R_p$ between the magnet pole faces (see FIG. 6). Overfocusing and less efficiency is observed for a radius of curvature of 20 mm, and underfocusing (greater divergence) is observed for a radius of curvature of 80 mm. Based on information available to date, the preferred range is 30 mm ($0.9\Delta R_p$) to 50 mm ($1.5\Delta R_p$). The degree of focusing achieved with field lines having the specified radius of curvature achieves high efficiency when the $B_{max}$ line is pushed to a location downstream of the magnet poles.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An ion accelerator with closed electron drift having an annular gas discharge area including an exit end, discharge of gas through the exit end defining a downstream direction, said accelerator comprising:

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force; and a magnetic flux bypass component for shaping the magnetic field in the area of the exit end of the gas discharge area, said component comprising:

a downstream inner ring of magnetically permeable material located at the inside of and encircled by the annular gas discharge area adjacent to the exit end;

an upstream inner ring of magnetically permeable material located at the inside of and encircled by the annular gas discharge area at a location a substantial distance upstream from the downstream inner ring;

an inner quantity of magnetically permeable material magnetically coupling the downstream inner ring and the upstream inner ring;

a downstream outer ring of magnetically permeable material located at the outside of and encircling the annular discharge area adjacent to the exit end;

an upstream outer ring of magnetically permeable material located outside of and encircling the annular gas discharge area at a location a substantial distance upstream from the downstream outer ring;

an outer quantity of magnetically permeable material magnetically coupling the downstream outer ring and the upstream outer ring; and an upstream quantity of magnetically permeable material coupling the upstream inner ring and the upstream outer ring to form a continuous magnetic path from the downstream inner ring through the inner quantity of magnetically permeable material to the upstream inner ring, through the upstream quantity of magnetically permeable material to the upstream outer ring, and through the outer quantity of magnetically permeable material to the downstream outer ring, at least one of said quantities of magnetic material having openings therethrough for regulating the reluctance of the magnetic path to control the shape of the magnetic field in the vicinity of the exit end of the gas discharge area.

2. The accelerator defined in claim 1, in which the inner rings are of the same diameter and aligned in a downstream-upstream direction, defining a circumferential inner side of the magnetic flux bypass component, and the outer rings being of the same diameter and aligned in an upstream-downstream direction to define an outer circumferential side of the bypass component.

3. The accelerator defined in claim 1, in which the downstream inner ring has a downstream edge, the angle formed by a line joining the downstream edge and the inner magnetic pole relative to a radius of the annular gas discharge area intersecting the inner magnetic pole being between 20° and 80°.

4. The accelerator defined in claim 3, in which the angle is about 45°.

5. The accelerator defined in claim 1, in which the openings are in the upstream quantity of magnetically permeable material and constitute the major portion of the area between the upstream rings.

6. The accelerator defined in claim 5, in which the openings in the upstream quantity of magnetically permeable material constitute more than 90% of the area between the upstream rings.

7. The accelerator defined in claim 5, in which the upstream quantity of magnetically permeable material couples the upstream rings at a location upstream of the anode.

8. The accelerator defined in claim 5, in which the upstream quantity of magnetically permeable material is formed by narrow radial ribs extending between the upstream rings.

9. The accelerator defined in claim 1, in which upstream rings are magnetically coupled across a narrow annular gap.

10. The accelerator defined in claim 1, in which the openings are in the inner quantity of magnetically permeable material.

11. The accelerator defined in claim 1, in which the openings are in the outer quantity of magnetically permeable material.

12. The accelerator defined in claim 1, in which each of the inner quantity of magnetically permeable material, outer quantity of magnetically permeable material, and upstream quantity of magnetically permeable material have openings therein and, in each instance, the openings constituting the major portion of the area encompassed by the respective quantity of magnetically permeable material.

13. The accelerator defined in claim 1, in which the inner quantity of magnetically permeable material includes circumferentially spaced strips of magnetically permeable material joining the inner rings, and the outer quantity of magnetically permeable material includes circumferentially spaced strips of magnetically permeable material joining the outer rings.

14. The accelerator defined in claim 1, in which the magnetic flux bypass component is constructed and arranged relatively so that a magnetic field line of maximum strength produced by the magnetic field source is located downstream of the inner and outer magnetic poles, and a magnetic field line having a value of 0.85 of the maximum magnetic field strength, upstream of the line of maximum strength, has a radius of curvature of about 40 mm.

15. The accelerator defined in claim 14, in which the radius of curvature is about 0.85 of the distance between the inner and outer magnetic poles.

16. The accelerator defined in claim 1, including a coating of insulated material on the faces of the magnetic poles remote from the discharge area.

17. The accelerator defined in claim 16, in which the coating is plasma sprayed aluminum oxide over plasma sprayed nickel.

18. The accelerator defined in claim 16, in which the radius of curvature is about 0.85 of the distance between the inner magnetic pole and the outer magnetic pole.

19. The accelerator defined in claim 16, in which the radius of curvature is between 30 mm and 50 mm.

20. The accelerator defined in claim 16, in which the radius of curvature is about 40 mm.

21. An ion accelerator with closed electron drift having an annular gas discharge area including an exit end, discharge of gas through the exit end defining a downstream direction, said accelerator comprising:

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force; and a magnetic flux bypass component for shaping the magnetic field in the area of the exit end of the gas discharge area, said component comprising:

a downstream inner ring of magnetically permeable material located at the inside of and encircled by the annular gas discharge area adjacent to the exit end;

an upstream inner ring of magnetically permeable material located at the inside of and encircled by the annular gas discharge area at a location a substantial distance upstream from the downstream inner ring;

an inner quantity of magnetically permeable material magnetically coupling the inner rings;

a downstream outer ring of magnetically permeable material located at the outside of and encircling the annular discharge area adjacent to the exit end;

an upstream outer ring of magnetically permeable material located outside of and encircling the annular gas discharge area at a location a substantial distance upstream from the downstream outer ring;

an outer quantity of magnetically permeable material magnetically coupling the outer rings; and an upstream quantity of magnetically permeable material coupling the upstream rings to form a continuous magnetic path from the downstream inner ring through the inner quantity of magnetically permeable material to the upstream inner ring, through the upstream quantity of magnetically permeable material to the upstream outer ring, and through the outer quantity of magnetically permeable material to the downstream outer ring, the magnetic flux bypass component being constructed and arranged so that a line of maximum magnetic field strength is located downstream of the inner magnetic pole and outer magnetic pole and the radius of curvature of a magnetic field line having a value of 0.85 of the maximum magnetic field strength, in an upstream direction from the line of maximum magnetic field strength, has a radius of curvature between a factor of 0.9 and 1.5 of the distance between the inner magnetic pole and the outer magnetic pole.

22. The accelerator defined in claim 21, including a coating of insulated material on the faces of the magnetic poles remote from the discharge area.

23. The accelerator defined in claim 22, in which the coating is plasma sprayed aluminum oxide over plasma sprayed nickel.

24. An ion accelerator with closed electron drift having an annular gas discharge area including an exit end, discharge of gas through the exit end defining a downstream direction, said accelerator comprising:

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force; and a magnetic flux bypass component for shaping the magnetic field in the area of the exit end of the gas discharge area, said component comprising:

a downstream inner ring of magnetically permeable material located at the inside of and encircled by the annular gas discharge area adjacent to the exit end;

an upstream inner ring of magnetically permeable material located at the inside of and encircled by the annular gas discharge area at a location a substantial distance upstream from the downstream inner ring;

an inner quantity of magnetically permeable material magnetically coupling the inner rings;

a downstream outer ring of magnetically permeable material located at the outside of and encircling the annular discharge area adjacent to the exit end;

an upstream outer ring of magnetically permeable material located outside of and encircling the annular gas discharge area at a location a substantial distance upstream from the downstream outer ring;

an outer quantity of magnetically permeable material magnetically coupling the outer rings; and an upstream quantity of magnetically permeable material coupling the upstream rings to form a continuous magnetic path from the downstream inner ring through the inner quantity of magnetically permeable material to the upstream inner ring, through the upstream quantity of magnetically permeable material to the upstream outer ring, and through the outer quantity of magnetically permeable material to the outer ring, the magnetic flux bypass component being constructed and arranged so that the line of maximum magnetic field strength is located downstream of the inner magnetic pole and outer magnetic pole, and the faces of the magnetic poles remote from the discharge area having a coating of insulative material.

25. The accelerator defined in claim 24, including a coating of insulated material on the faces of the magnetic poles remote from the discharge area.

26. The accelerator defined in claim 25, in which the coating is plasma sprayed aluminum oxide over plasma sprayed nickel.

27. A magnetic flux shaping component for an ion accelerator with closed electron drift, the accelerator having:

an annular gas discharge area including an exit end, discharge of gas through the exit end defining a downstream direction;

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force;

said magnetic flux shaping component comprising:

a downstream inner ring of magnetically permeable material for being located at the inside of and encircled by the annular gas discharge area adjacent to the exit end;

an upstream inner ring of magnetically permeable material for being located at the inside of and encircled by the annular gas discharge area at a location a substantial distance upstream from the downstream inner ring;

an inner quantity of magnetically permeable material magnetically coupling the downstream inner ring and the upstream inner ring;

a downstream outer ring of magnetically permeable material for being located at the outside of and encircling the annular discharge area adjacent to the exit end;

an upstream outer ring of magnetically permeable material for being located outside of and encircling the annular gas discharge area at a location a substantial distance upstream from the downstream outer ring;

an outer quantity of magnetically permeable material magnetically coupling the downstream outer ring and the upstream outer ring; and an upstream quantity of magnetically permeable material coupling the upstream inner ring and the upstream outer ring to form a continuous magnetic path from the downstream inner ring through the inner quantity of magnetically permeable material to the upstream inner ring, through the upstream quantity of magnetically permeable material to the upstream outer ring, and through the outer quantity of magnetically permeable material to the downstream outer ring, at least one of said quantities of magnetic material having openings therethrough for regulating the reluctance of the magnetic path to control the shape of the magnetic field in the vicinity of the exit end of the gas discharge area of the accelerator.

28. The method of shaping the generally radially directed magnetic field in an accelerator with closed electron drift which accelerator has:

an annular gas discharge area including an exit end, discharge of gas through the exit end defining a downstream direction;

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force;

which method comprises shunting magnetic flux produced by the magnetic field source along a magnetic path from adjacent to the inner magnetic pole, upstream to a location upstream of the anode, outward to a location outward of the anode, and downstream to a location adjacent to the outer magnetic pole, the reluctance of the magnetic path being selected such that the maximum magnetic field strength is located downstream of the inner magnetic pole and outer magnetic pole, and the curvature of a magnetic field line having a value of 0.85 of the maximum magnetic field strength, in an upstream direction from the line of maximum magnetic field strength, has a radius of curvature between a factor of 0.9 and 1.5 of the distance between the inner magnetic pole and the outer magnetic pole.

29. The method of shaping the generally radially directed magnetic field in an accelerator with closed electron drift which accelerator has:

an annular gas discharge area including an exit end, discharge of gas through the exit end defining a downstream direction;

an inner magnetic pole located at the inside of and encircled by the annular gas discharge area adjacent to the exit end;

an outer magnetic pole located at the outside of and encircling the annular gas discharge area adjacent to the exit end;

a magnetic field source for producing a generally radially extending magnetic field between the inner pole and the outer pole in the vicinity of the exit end of the gas discharge area;

an anode located upstream of the exit end of the gas discharge area;

a gas source for supplying an ionizable gas to the gas discharge area for flow in a downstream direction toward the exit end;

an electron source for supplying free electrons for introduction toward the exit end of the gas discharge area in a generally upstream direction;

an electric field source for producing an electric field extending from the anode in a downstream direction through the exit end, interaction between the ionizable gas from the gas source and free electrons from the electron source producing ions accelerated in a downstream direction by the electric field to produce a propelling reaction force;

which method comprises shunting magnetic flux produced by the magnetic field source along a magnetic path from adjacent to the inner magnetic pole, upstream to a location upstream of the anode, outward to a location outward of the anode, and downstream to a location adjacent to the outer magnetic pole, the reluctance of the magnetic path being selected such that the maximum magnetic field strength is located downstream of the inner magnetic pole and outer magnetic pole, and the curvature of a magnetic field line having a value of 0.85 of the maximum magnetic field strength, in an upstream direction from the line of maximum magnetic field strength, has a radius of curvature between 30 mm and 50 mm.

* * * * *